166-274 SR
7/24/84 XR 4,461,350

United States Patent [19]
Hunt, III

[11] Patent Number: 4,461,350
[45] Date of Patent: Jul. 24, 1984

[54] THERMAL SOLVENT RECOVERY METHOD UTILIZING VISBROKEN PRODUCED CRUDE OIL

[75] Inventor: William C. Hunt, III, Farmers Branch, Tex.

[73] Assignee: Mobil Oil Corporation, New York, N.Y.

[21] Appl. No.: 331,425

[22] Filed: Dec. 16, 1981

[51] Int. Cl.[3] ..... E21B 43/24; E21B 43/40
[52] U.S. Cl. ..... 166/272; 166/266; 166/274
[58] Field of Search ..... 166/266, 267, 303, 272, 166/274

[56] References Cited

U.S. PATENT DOCUMENTS

| | | | |
|---|---|---|---|
| 2,897,894 | 8/1959 | Draper et al. | 166/272 |
| 3,103,972 | 9/1963 | Parker | 166/266 |
| 3,137,344 | 6/1964 | Wiemer | 166/266 X |
| 3,228,467 | 1/1966 | Schlinger et al. | 166/266 |
| 3,354,953 | 11/1967 | Morse | 166/266 |
| 3,357,487 | 12/1967 | Gilchrist et al. | 166/303 X |
| 3,500,918 | 3/1970 | Holm | 166/274 X |
| 3,528,501 | 9/1970 | Parker | 166/266 |
| 3,881,550 | 5/1975 | Barry | 166/266 X |
| 4,008,764 | 2/1977 | Allen | 166/266 |

OTHER PUBLICATIONS

*The Condensed Chemical Dictionary,* Sixth Edition, Reinhold Publishing Corp., New York, p. 777.
*Modern Petroleum Technology,* 4th Edition, John Wiley & Sons, New York, 1973, pp. 696–698, 704 and 705.

*Primary Examiner*—Stephen J. Novosad
*Attorney, Agent, or Firm*—Alexander J. McKillop; Michael G. Gilman; Lawrence O. Miller

[57] ABSTRACT

A method for the recovery of viscous crude oil from a subterranean, viscous crude oil-containing formation penetrated by an injection well and a spaced-apart production well wherein produced crude oil recovered from the production well is subjected to a visbreaking operation to produce a hot visbroken crude oil solvent reduced in viscosity and injecting the hot visbroken crude oil solvent into the formation via the injection well to reduce the viscosity of oil remaining in the oil formation and thereby enhance recovery of oil from the formation. A predetermined amount or slug of the hot visbroken crude oil solvent may be injected into the formation followed by injection of another fluid such as a gas or an aqueous fluid to drive the hot solvent and the oil through the formation toward the production well for recovery of fluids including oil.

10 Claims, 1 Drawing Figure

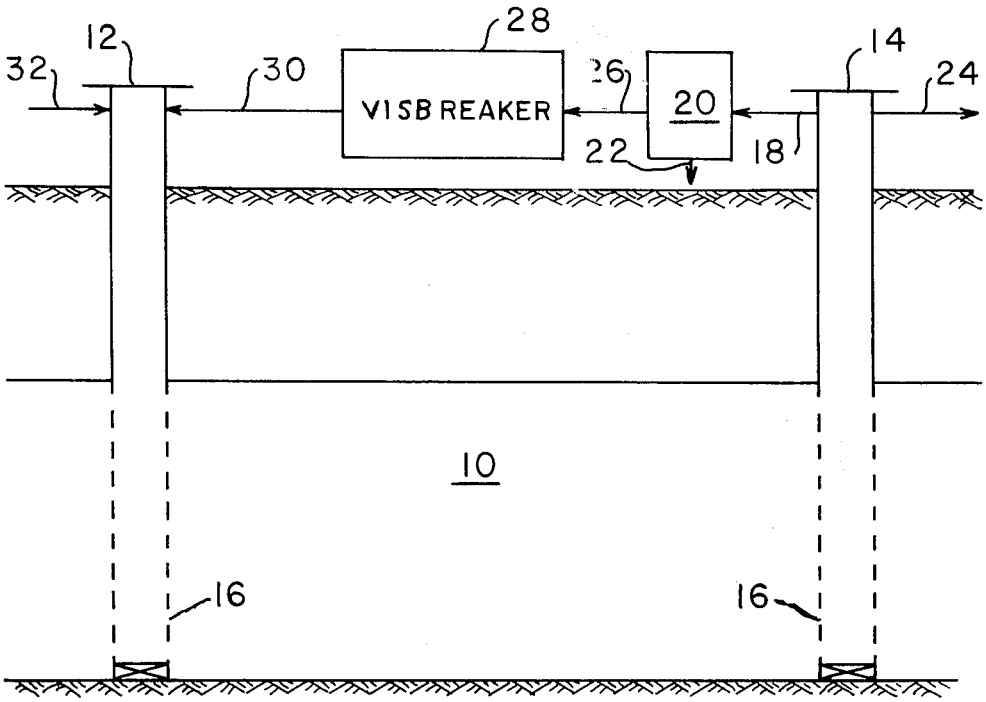
28
12
14
32
30
VISBREAKER
26
20
24
22
18
10
16
16

THERMAL SOLVENT RECOVERY METHOD UTILIZING VISBROKEN PRODUCED CRUDE OIL

FIELD AND BACKGROUND OF THE INVENTION

1. Field of the Invention

The invention relates to a thermal solvent oil recovery method utilizing hot visbroken produced crude oil as the solvent injected into the oil formation in order to reduce the viscosity of the oil remaining in the formation and thereby enhance recovery of the oil from the formation.

2. Background of the Invention

Current primary oil production practices fail to recover much of the oil originally in place in natural formations. As a consequence thereof, much effort has been devoted to devising so-called secondary recovery methods of improving the ultimate recovery of the oil in the formations.

Various methods for inducing the recovery of viscous oil from underground formations are in existance. One such method is miscible flooding wherein a solvent for the oil is introduced into the formation and driven through the formation to displace the oil toward a production well from which oil is recovered. The solvents employed in these processes are expensive and the cost of solvent flooding is usually excessive in relation to the oil production obtainable thereby.

In U.S. Pat. No. 3,080,918 to Natland there is disclosed a process for heating produced oil by means of a nuclear reactor and passing the heated oil into the oil formation to reduce the viscosity of the oil and stimulate its recovery. The nuclear reactor is positioned in the well through which the produced oil is injected into the formation.

U.S. Pat. No. 4,174,752 to Slater et al discloses a method for heating recovered crude oil by solar means at the site of recovery thereof and injecting at least a portion of such heated crude oil back into the oil formation in order to reduce the viscosity of oil remaining in the oil formation and thereby allow a greater recovery of crude oil from the formation.

The present method is an improved thermal solvent oil recovery method in that it subjects a portion of the produced crude oil to a visbreaking operation to produce a hot visbroken crude oil solvent having reduced viscosity and injecting the hot visbroken crude oil solvent into the formation to stimulate recovery of oil contained therein.

BRIEF DESCRIPTION OF THE DRAWING

The drawing is a schematic view of a viscous crude oil-containing formation penetrated by an injection well and a production well illustrating the method for recovering crude oil utilizing hot visbroken produced crude oil as a solvent according to this invention.

SUMMARY OF THE INVENTION

This invention is a method for recovering viscous crude oil from a subterranean, viscous crude oil-containing formation penetrated by an injection well and a spaced-apart production well wherein crude oil is produced from the production well and a portion of produced crude oil is subjected to a visbreaking operation to produce a hot visbroken crude oil solvent having reduced viscosity and injecting the hot visbroken oil solvent into the formation via the injection well to reduce the viscosity of the oil in the formation and thereby enhance its recovery.

The method also involves injecting a predetermined amount or slug of the hot visbroken crude oil solvent into the formation via the injection well followed by introducing a gas or aqueous drive fluid to displace the solvent and the oil reduced in viscosity through the formation toward the production well from which crude oil is produced.

DETAILED DESCRIPTION OF THE PREFERRED EMBODIMENTS

The present invention relates to a thermal solvent method for the recovery of crude oil from a formation penetrated by at least one injection well and a spaced-apart production well in which the solvent comprises hot visbroken crude oil produced by subjecting a portion of the produced crude oil to a visbreaking operation.

Referring to the drawing, a subterranean, viscous oil-containing formation 10 is penetrated by an injection well 12 and a spaced apart production well 14, each well being in fluid communication with a substantial portion of the formation through perforations 16.

Crude oil is produced via production well 14 and a portion of the produced oil is drawn off through line 18 and introduced into a tank 20 where water is separated from the produced crude oil and withdrawn through line 22. The remaining portion of produced crude oil from the production well 14 is drawn off as production by line 24 and transported to a point of use, transfer, or storage. Produced crude oil, free of water, is withdrawn from tank 20 through line 26 and introduced into a visbreaker 28 and heated therein to a selected temperature, pressure, and for a sufficient length of time to produce a visbroken crude oil having reduced viscosity.

Visbreaking, or viscosity breaking, is a process wherein crude oil is pyrolyzed, or cracked, under comparatively mild conditions without significant coke production to provide a product having a lower viscosity. Visbreaking processes include those described in U.S. Pat. Nos. 4,203,830 and 4,233,138 to Rollman et al and as much of these patents as is pertinent is incorporated by reference herein.

It is preferred that the visbreaking operation be conducted at selected temperatures, pressure and length of heating time sufficient to reduce the viscosity of the produced crude oil within the range of 80 to 95%. The optimum temperature, pressure and heating time required to obtain the desired reduction in viscosity will depend upon the characteristics of the produced crude oil. The viscosity reduction of the visbroken crude oil may be monitored periodically by taking samples of the visbroken oil and measuring the viscosity by suitable means. Once the produced crude oil has been reduced in viscosity to the desired value, the hot visbroken crude oil is withdrawn from visbreaker 28 through line 30 and injected into formation 10 via injection well 12.

The injected hot visbroken produced crude oil solvent invades the formation, dissolves viscous oil in the formation 10 and dissipates its heat to the formation thereby reducing the viscosity of the oil therein and continued injection of the hot solvent displaces the mobilized oil through the formation toward production well 14 from which it is recovered.

As the process is continued, the viscosity of the produced crude oil via production well 14 will gradually decrease, thereby decreasing the amount of heat required by the visbreaker 28 to achieve the desired reduction in the viscosity of the produced crude oil.

In another embodiment of the invention, a predetermined quantity or slug of hot visbroken produced crude oil, preferably from about 0.05 to about 0.30 pore volume, is injected into the formation 10 through the injection well 12 via line 30 followed by injecting a gas or an aqueous driving fluid into the formation through the injection well via line 32 to drive the solvent slug and the oil through the formation. The hot visbroken crude oil solvent gives up its heat to the oil and dissolves in the oil on contact reducing the viscosity of the oil and enhancing its recovery. Injection of the driving fluid is continued and fluids including oil are recovered from the formation via said production well until the fluids being recovered contain an unfavorable ratio of oil to driving fluid. In addition, prior to injecting the driving fluid and after the visbroken produced crude oil solvent has been injected, both the injection and production wells 12 and 14 are shut-in to allow the formation to undergo a soak period for a predetermined amount of time. Soaking time will vary depending upon the characteristics of the formation such as the viscosity of the oil contained therein, porosity, thickness of the formation,etc. During the soak period, the solvent dissolves in the oil and its heat is dissipated throughout the formation thereby securing maximum benefits of the solvent in reducing the viscosity of the oil and enhancing its recovery. Once the desired soak period is over, a driving fluid is injected into the formation 10 via said injection well 12 via line 32 and production of fluids including oil is resumed via said production well 14. Injection of driving fluid and production is continued until the fluids including oil recovered from the formation 10 via said production well 14 contain an unfavorable ratio of oil to driving fluid.

As stated, the driving fluid may be a gas or an aqueous fluid. Aqueous driving fluids include water or water solutions such as brine. The term water or aqueous fluid may also include water thickened with polymers or other mobility control agents to increase the viscosity thereof and thereby improve its area sweep efficiency. Gaseous drive fluids may include natural gas, methane, ethane, carbon dioxide, air and nitrogen.

By the term "pore volume" as used herein, is meant that volume of the portion of the formation underlying the well pattern employed as described in greater detail in U.S. Pat. No. 3,927,716 to Burdyn et al, the disclosure of which is hereby incorporated by reference.

While the invention has been described in terms of a single injection well and a single spaced apart production well, the method according to the invention may be practiced using a variety of well patterns. Any other number of wells, which may be arranged according to any pattern, may be applied in using the present method as illustrated in U.S. Pat. No. 3,927,716 to Burdyn et al.

From the foregoing specification one skilled in the art can readily ascertain the essential features of this invention and without departing from the spirit and scope thereof can adapt it to various diverse applications. It is my intention and desire that my invention be limited only by those restrictions or limitations as are contained in the claims appended immediately hereinafter below.

What is claimed is:

1. A method for the recovery of viscous crude oil from a subterranean, viscous crude oil-containing formation penetrated by at least one injection well and one spaced apart production well comprising:

(a) producing crude oil from the formation via said production well;

(b) subjecting at least a portion of said produced crude oil to a thermal visbreaking operation to produce solely by said visbreaking operation a hot visbroken crude oil having a viscosity within the range of 80 to 95% less than the viscosity of the produced crude oil;

(c) injecting a predetermined amount of said hot visbroken crude oil into said formation via said injection well;

(d) thereafter injecting a drive fluid into the formation via said injection well to force the visbroken produced oil through the formation; and (e) continuing production of crude oil from the formation via said production well.

2. The method of claim 1 wherein the amount of hot visbroken crude oil injected into the formation via said injection well is from about 0.05 to about 0.30 pore volume.

3. The method of claim 1 wherein the drive fluid comprises a gas selected from the group consisting of natural gas, methane, ethane, carbon dioxide, air and nitrogen.

4. The method of claim 1 wherein the drive fluid comprises water.

5. The method of claim 4 wherein the said water contains a dissolved viscosity-increasing additive.

6. The method of claim 1 wherein production is continued until the crude oil recovered from the formation via said production well contains an unfavorable ratio of oil to driving fluid.

7. The method of claim 1 further comprising the additional step of shutting in said injection well and said production well after the predetermined amount of hot visbroken crude oil has been injected into the formation in step (c) to permit said formation to undergo a soak period for a predetermined amount of time.

8. The method of claim 1 further including the step of separating water from the produced crude oil after step (a).

9. A method for the recovery of viscous crude oil from a subterranean, viscous crude oil-containing formation penetrated by at least one injection well and one spaced apart production well comprising:

(a) producing crude oil from the formation via said production well;

(b) subjecting at least a portion of said produced crude oil to a thermal visbreaking operation to produce solely by said visbreaking operation a hot visbroken crude oil having a viscosity within the range of 80 to 95% less than the viscosity of the produced crude oil; and (c) injecting said hot visbroken crude oil into said formation via said injection well to reduce the viscosity of the oil in the formation and displace the oil through the formation toward said production well thereby allowing a greater recovery of oil from the formation.

10. The method of claim 9 further including the step of separating water from the produced crude oil after step (a).

* * * * *